United States Patent [19]

Lewis

[11] 3,954,095

[45] May 4, 1976

[54] BOW STRING RELEASE DEVICE

[76] Inventor: Kenneth Don Lewis, N. Hollywood Road, Nekoosa, Wis. 54457

[22] Filed: Aug. 11, 1975

[21] Appl. No.: 603,269

Related U.S. Application Data

[63] Continuation of Ser. No. 441,156, Feb. 11, 1974, abandoned.

[52] U.S. Cl. ..... 124/35 A; 124/30 R

[51] Int. Cl.[2] ..... F41C 5/00

[58] Field of Search ..... 124/35 A, 41, 30 R, 124/24 R, 35 R, 20 R

[56] References Cited

UNITED STATES PATENTS

| | | | |
|---|---|---|---|
| 2,000,015 | 5/1935 | Flury | 124/35 A |
| 2,842,114 | 7/1958 | Duncan | 124/25 |
| 2,936,749 | 5/1960 | Chellstorp | 124/35 A |
| 3,490,429 | 1/1970 | Benedict | 124/35 R |
| 3,494,346 | 2/1970 | Yount et al. | 124/20 R |
| 3,572,312 | 3/1971 | Foster | 124/30 R |
| 3,745,986 | 7/1973 | Crowson | 124/35 R |
| 3,757,763 | 9/1973 | Pinti | 124/35 A |
| 3,845,752 | 11/1974 | Barner | 124/35 A |

*Primary Examiner*—Richard C. Pinkham
*Assistant Examiner*—William R. Browne
*Attorney, Agent, or Firm*—Theodore J. Long; John M. Winter; Harry C. Engstrom

[57] ABSTRACT

A bow string release device having a hand grip member and a rotatable latch mounted thereto which engages a bow string in an open position and rotates to a closed position to securely hold the bow string. A trigger member is slidably moveable in its entirety in a straight line within the hand grip member and slidingly engages the latch member to hold it in its closed position. The trigger member is moved rearwardly in the hand grip member by being squeezed by a finger of an archer until the trigger member clears the latch member, at which point the latch member is free to rotate to its open position and release the bow string. A wrist belt is attached to the hand grip member to aid the archer in drawing back the bow string.

6 Claims, 4 Drawing Figures

BOW STRING RELEASE DEVICE

This application is a continuation of U.S. application Ser. No. 441,156, filed Feb. 11, 1974, now abandoned.

BACKGROUND OF THE INVENTION

1. Field of the Invention

This invention relates to the sport of archery and more particularly to devices and accessories used with the bow.

2. Description of the Prior Art

In the usual manual shooting of a bow and arrow, the bow string and the arrow are pulled back by the ends of the fingers of one hand of the archer, an operation that requires considerable muscular strength in the archer's fingers. The difficulty encountered in holding the bow string often results in erratic release of the string by the archer, and a concurrent loss of accuracy.

Various devices have been developed which allow the archer to pull back the bow string by pulling on a bow string release device with the ends of the fingers of the hand, with release of the bow string being accomplished by pulling with a finger on a trigger that is provided on the device. These known bow string release devices generally still require that the entire force of pulling on the bow string be provided by the ends of the fingers of a hand, and provide no means for allowing the pull to be carried by the entire grip of a hand or otherwise than by the fingers. Moreover, the known trigger release devices for archery bows and the like generally employ a rotating trigger mechanism which requires that the trigger be moved by the archer's finger against the strong pull force exerted by the bow string through what is essentially a lever to the trigger. This requires the archer to "snap" the trigger to release the arrow, which limits the accuracy obtainable with such a release.

SUMMARY OF THE INVENTION

A principal object of the present invention is to provide a hand held means for securing the bow string in a latch for release at will on pressing the latch-holding trigger. The latch member is rotatably mounted to a hand grip member having a slot therein to receive the bow string, and with the latch member also being slotted to receive the bow string and biased to an open or release position by a spindle-mounted spring. A combination latching and trigger member is biased into a non-operative forward position by a compression spring, and prevents the release of the bow string by the latch member until the trigger is pressed by the finger of an archer holding the release device. Reloading is automatically accomplished since movement of the bow string into engagement with the latch member turns the latch member against its spring in rotating motion, with the rotating action of the latch member in turn retracting the trigger member against its spring until the trigger member is free to snap forward and thereby lock the latch member in its closed position. An adjustment screw is used to set the sensitivity of the release, and three rubber bumpers are provided to absorb shock in the moving parts. An adjustable wrist belt retains the device on the wrist of the archer for ready use, and assists the fingers of the archer in pulling the bow string back.

A further object is the ability to hold back a heavier bow for a longer period of time.

A yet further object of the present invention is to provide and obtain a smooth and accurate release.

A still further object is to permit the use of heavy gloves in cold weather.

Another object is to provide an adjustable trigger for length of trigger squeeze.

Another object is to obtain the same speed of release as finger tabs.

Another object is to prevent the string from slipping off before shooting.

Another object is to allow use by a right or left handed person.

Another object is to allow the bow string to be pulled back with the arm rather than the fingers by use of the wrist belt.

Further objects, features, and advantages will be apparent from the following detailed description taken in conjunction with the accompanying drawings showing a preferred embodiment of a bow string release device exemplifying the principles of my invention.

DESCRIPTION OF THE PREFERRED EMBODIMENT

Figure 1:
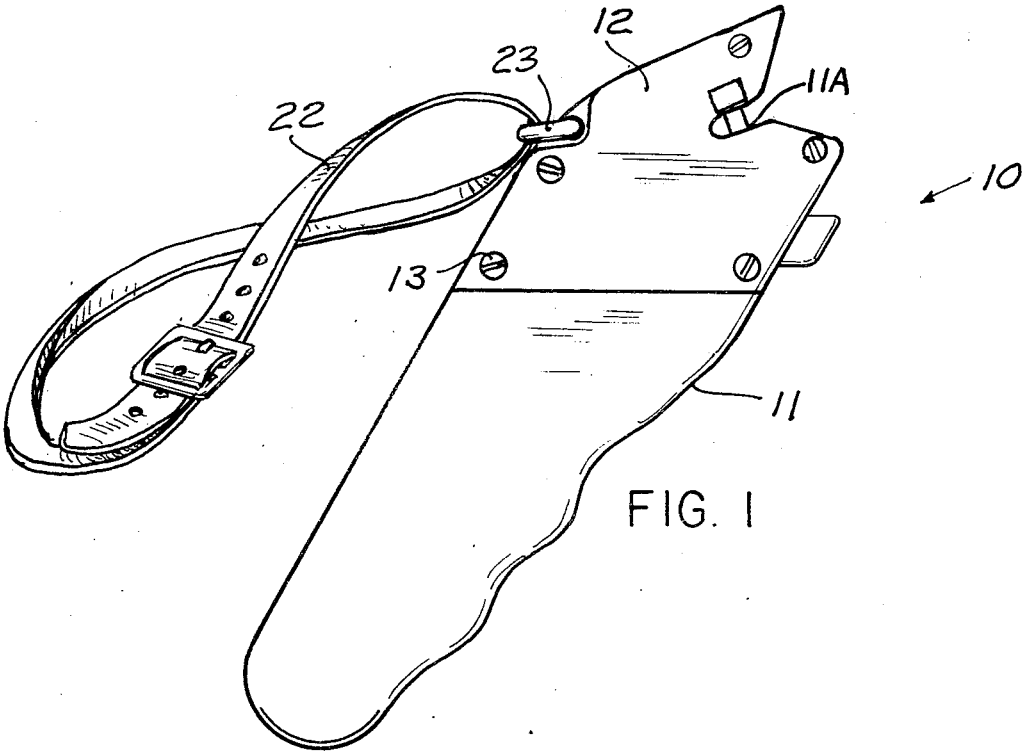
FIG. 1 is a general view of my bow string release device.

Referring now more particularly to the drawings, wherein like numerals refer to like parts throughout the several views, a preferred embodiment of my bow string release device is shown generally at 10 in FIG. 1. The bow string release device 10 comprises a hand grip member 11 having a mechanism chamber therein and having a slot 11*a* for receiving a bow string, a cover plate 12 therefor and cover plate fastening screws 13, a bow string latch member 14, a spindling pin 15 therefor by which the bow string latch member is rotatably mounted to the hand grip member 11 in position to be engaged by a bow string inserted into the slot 11*a* as shown in FIGS. 2 and 3, a latch member biasing spring 16, a combination trigger and latch holding member 17, a biasing compression spring 18 therefor which is mounted as shown between the hand grip member and the trigger member, a trigger member adjustment screw 19, a pair of latch release rubber shocks 20*a* and 20*b*, a trigger member rubber shock 21 and a wrist belt 22 which is retained on a ring 23 which is mounted swivelly to the hand grip member 11.

Figure 2:
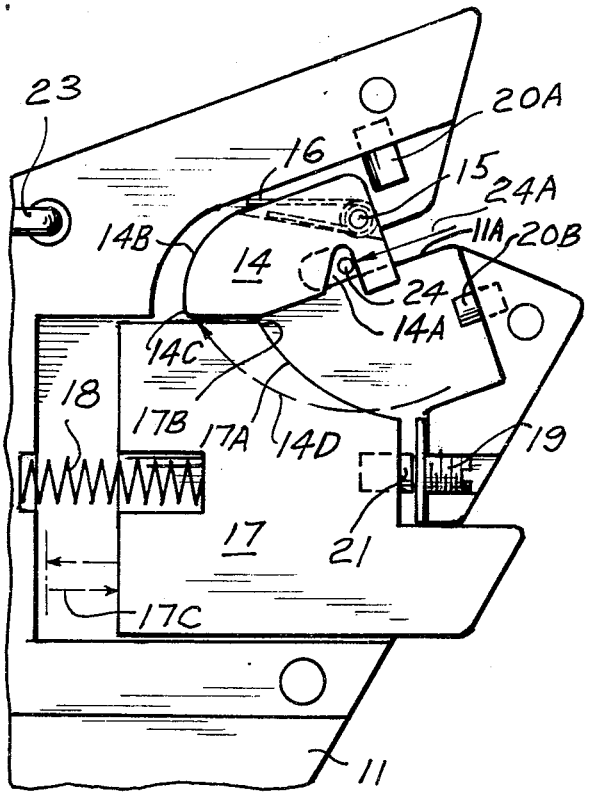
FIG. 2 is an enlarged fragmentary portion of the bow string release device of FIG. 1 with the cover plate removed and showing the loading of the device.
Figure 3:
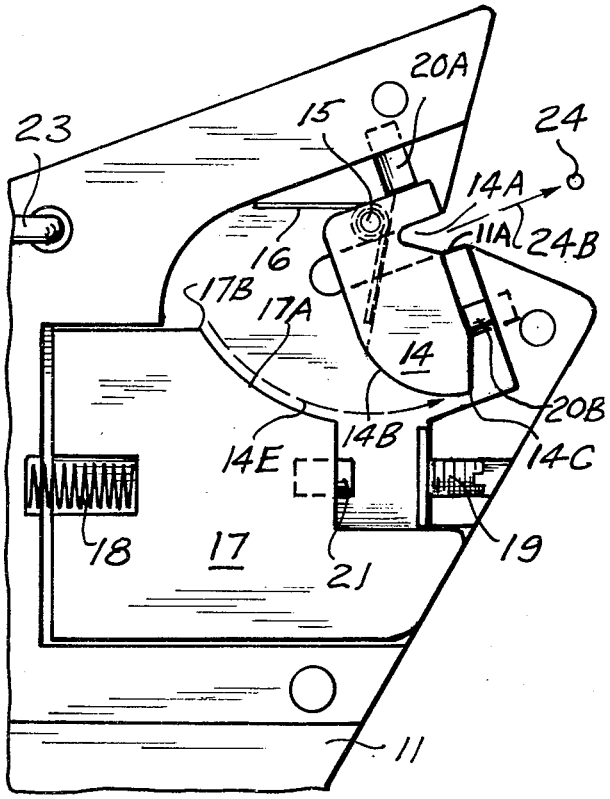
FIG. 3 is an enlarged fragmentary portion of the bow string release device of FIG. 1, with the cover plate removed and showing the release of the bow string.
Figure 4:
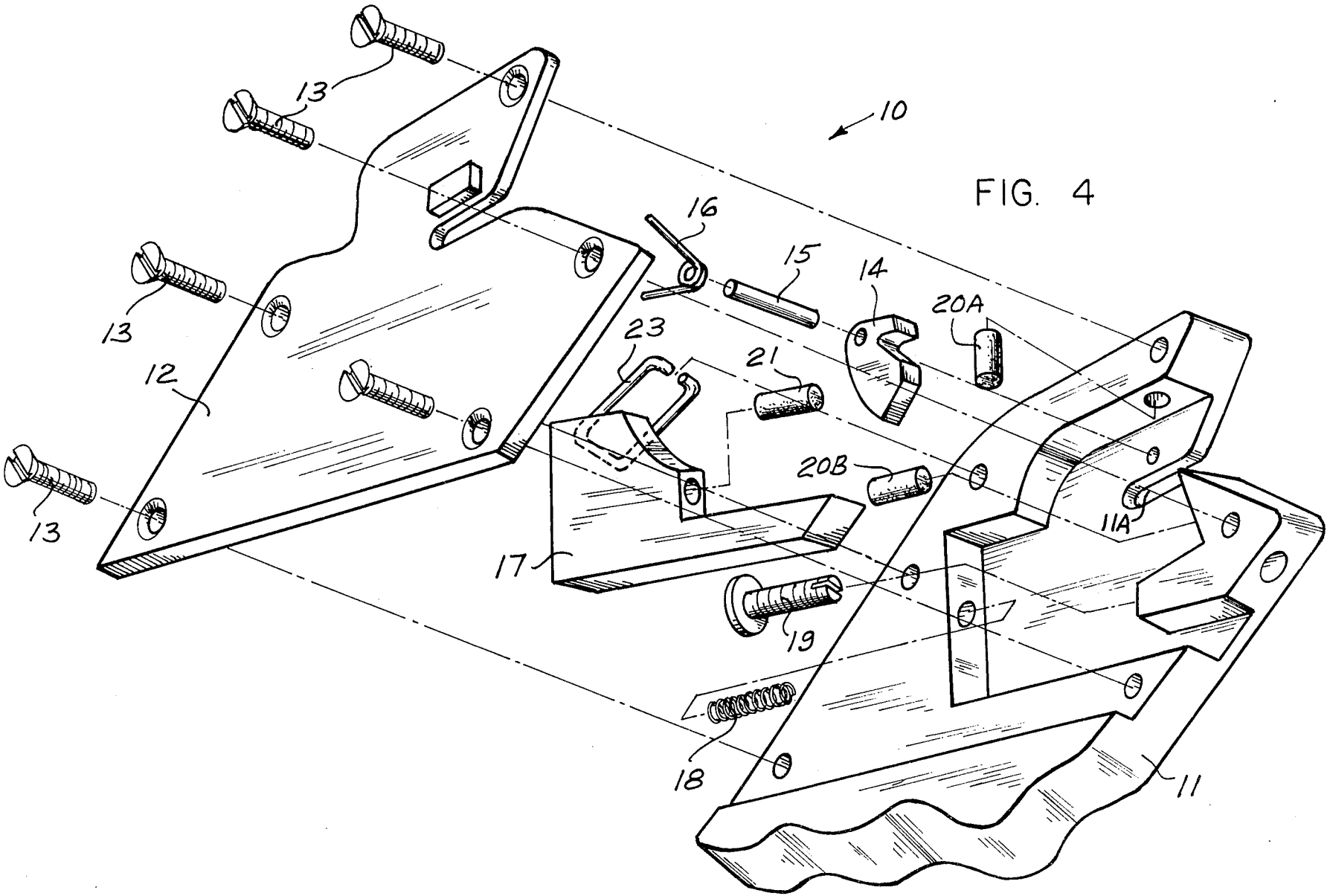
FIG. 4 is an exploded perspective view of the bow string release device of FIG. 1.

In the loading operation the moving parts are in their biased position, that is, the latch member 14 is in its open position as shown in FIG. 3, and the trigger member 17 is in its forward position as shown in FIG. 2. To load the release device, bow string 24, which is shown in section in FIGS. 2–3, is drawn back in the slot 11*a* of the hand grip member until the bow string engages with the walls of an opening 14*a* of the latch member 14. As the bow string 24 is moved into the slot 11*a* as indicated by the arrow 24*a* in FIG. 2, and into engagement with the walls of the opening 14*a*, the latch member 14 is turned clockwise against the spring 16. This causes a camming surface 14*b* of the latch member 14 to work against a trigger surface 17*a* of the trigger member 17 to slidingly move the trigger member 17 rearward within the hand grip member 11 to the point where a corner 14*c* of the latch member 14 clears a corner 17*b* of the trigger member 17. The clockwise movement of the latch member 14 is indicated by the arrow 14*d* in FIG. 2. After the latch member corner 14*c* clears the trigger member 17*b*, the trigger member is free to snap forward under the force supplied by the spring 18, with this sliding movement being indicated by the arrow 17*c*, and the parts of the bow string release device come to rest in the positions as shown in FIG. 2 with the trigger member 17 being in sliding engagememt with the latch member 14 to hold the latch member in its closed position. The bow string 24 is now held securely within the slot 11*a* by a wall of the opening 14*a* which now blocks the slot 11*a* with the latch member in its closed position, and the bow string may be drawn back by pull on the wrist belt 22 and by the grip of the archer's hand on the hand grip member 11.

To release the bow string, the trigger member 17 is squeezed by a finger of the archer and moves rearwardly in the hand grip member. When the trigger member 17 has moved sufficiently rearward such that the corner 17*b* of the trigger member clears the corner 14*c* of the latch 14, the latch is free to turn counterclockwise under the stress applied by the drawn bow string 24 and releases the bow string. The latch member 14 snaps forward until stopped by a pair of rubber shocks 20*a* and 20*b*. The movement of the latch member counterclockwise is indicated by the arrow 14*e* in FIG. 3, and the movement of the bow string released from the latch member is shown by the arrow 24*b* in FIG. 3.

It is understood that my invention is not confined to the particular construction and arrangement of parts herein illustrated and described, but embraces all such modified forms thereof as come within the scope of the following claims.

I claim:

1. A release device for a bow string, which is holdable in the hand of an archer, comprising:

a. a hand grip member having a slot therein for receiving a bow string;

b. bow string latch means rotatably mounted to said hand grip member for engaging a bow string inserted into said slot when said latch means is in an open position, and for rotating to a closed position when in engagement with a bow string to securely hold a bow string in said slot;

c. trigger means slidably movable in its entirety along a straight line within said hand grip member for holding said latch means in its closed position, and for sliding rearwardly within said hand grip member when pressed by a finger of an archer to release said latch means and allow said latch means to rotate to its open position and release a bow string.

2. The bow string release device as specified in claim 1 including spring means for normally biasing said latch means in said open position, and spring means for normally biasing said trigger means forwardly, and wherein rotation of said latch means from its open position to its closed position moves said trigger means rearwardly within said hand grip member until said latch means is in its closed position at which point said trigger means is allowed to slide forwardly under said spring biasing means to hold said latch means in its closed position.

3. The bow string release device as specified in claim 1 including a wrist belt attached to said hand grip member.

4. A release device for a bow string, which is holdable in the hand of an archer, comprising:

a. a hand grip member having a slot therein for receiving a bow string;

b. a bow string latch member having walls defining an opening therein, which is rotatably mounted to said hand grip member in position to be engaged and rotated by a bow string inserted in said slot and into engagement with the walls of said opening from a normally open position to a closed position, said latch member having a wall of said opening therein which blocks said slot to securely hold a bow string in said slot when said latch member is in said closed position;

c. a trigger means slidably movable in its entirety along a straight line in said hand grip member to allow forward and rearward sliding movement of said trigger member, said trigger means being positioned to be engaged by said latch member and moved rearwardly by said latch member as it rotates from its open position to its closed position, said trigger means having a corner which is in position to be cleared by said latch member to allow said trigger means to slide forwardly when said latch member is in its closed position, and said trigger means and said latch member being in sliding engagement when said corner of said trigger means is moved forwardly to hold said latch member in said closed position, whereby said trigger means may be moved rearwardly by being pressed by a finger of an archer until said corner of said trigger member clears said latch member which allows said latch member to rotate from its closed position to its open position and release a bow string.

5. The bow string release device as specified in claim 4 including a spring mounted between said trigger means and said hand grip member to bias said trigger means forwardly, and a spring mounted between said latch member and said hand grip member to bias said latch member in its open position.

6. The bow string release device as specified in claim 4 including a wrist belt attached to said hand grip member.

* * * * *